US008679713B2

(12) United States Patent
Matsumoto et al.

(10) Patent No.: US 8,679,713 B2
(45) Date of Patent: Mar. 25, 2014

(54) ELECTROSTATIC IMAGE-DEVELOPING TONER, ELECTROSTATIC IMAGE DEVELOPER, TONER CARTRIDGE, PROCESS CARTRIDGE, IMAGE-FORMING METHOD, AND IMAGE-FORMING APPARATUS

(75) Inventors: Akira Matsumoto, Kanagawa (JP); Yusuke Ikeda, Kanagawa (JP); Yukiaki Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 502 days.

(21) Appl. No.: 12/884,472

(22) Filed: Sep. 17, 2010

(65) Prior Publication Data

US 2011/0229813 A1 Sep. 22, 2011

(30) Foreign Application Priority Data

Mar. 18, 2010 (JP) ..... 2010-062246
Jun. 25, 2010 (JP) ..... 2010-144526

(51) Int. Cl.
*G03G 9/08* (2006.01)

(52) U.S. Cl.
USPC ..... 430/108.1; 430/124.1; 399/252

(58) Field of Classification Search
USPC ..... 430/108.1, 124.1; 399/252
See application file for complete search history.

(56) References Cited

U.S. PATENT DOCUMENTS

| | | | | |
|---|---|---|---|---|
| 2005/0048388 | A1 | 3/2005 | Lee et al. | |
| 2006/0105265 | A1 | 5/2006 | Michel et al. | |
| 2009/0053634 | A1 * | 2/2009 | Mitsumori et al. | 430/57.1 |
| 2010/0047706 | A1 | 2/2010 | Matsumura et al. | |

FOREIGN PATENT DOCUMENTS

| | | | |
|---|---|---|---|
| CN | 101655674 | A | 2/2010 |
| JP | A-56-11461 | | 2/1981 |
| JP | A-62-39879 | | 2/1987 |
| JP | A-05-085909 | | 4/1993 |
| JP | A-08-062897 | | 3/1996 |
| JP | A-2007-106094 | | 4/1997 |
| JP | A-2003-241423 | | 8/2003 |
| JP | A-2006-504830 | | 2/2006 |
| JP | A-2007-332302 | | 12/2007 |
| WO | WO 2004/092283 | A2 | 10/2004 |
| WO | WO 2009/035158 | AI | 3/2009 |

OTHER PUBLICATIONS

Aug. 6, 2012 Extended European Search Report issued in European Patent Application No. EP 10 18 7300.8.
Nov. 26, 2013 Office Action issued in Japanese Patent Application No. 2010-144526 (with translation).
Nov. 27, 2013 Office Action issued in Chinese Patent Application No. 201010510769.X (with translation).

* cited by examiner

*Primary Examiner* — Mark F Huff
*Assistant Examiner* — Rachel Zhang
(74) *Attorney, Agent, or Firm* — Oliff PLC

(57) ABSTRACT

An electrostatic image-developing toner comprising a binder resin, wherein the content of all the chlorine-substituted benzene derivatives in the electrostatic image-developing toner is about 0.01 ppb or more and about 10 ppb or less.

10 Claims, 1 Drawing Sheet

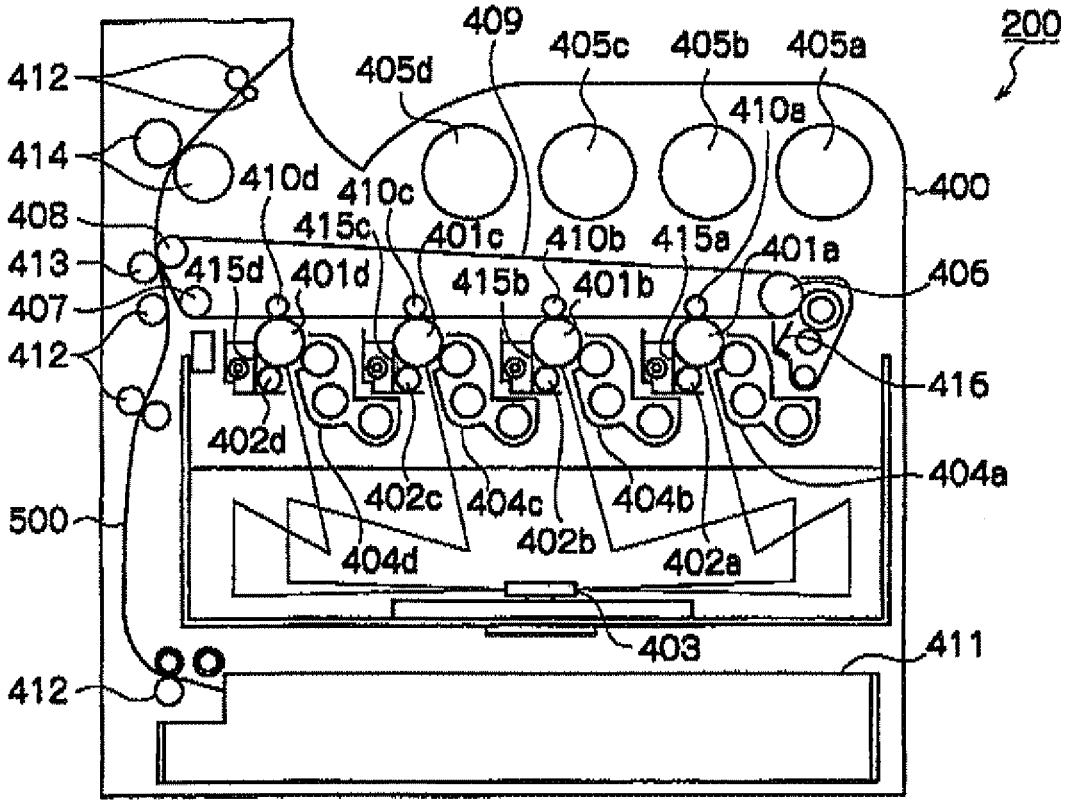
200
409
405c
405b
405a
405d
412
410a
414
410d
410c
400
408
415c
401c
410b
415a
401a
413
415d
401d
415b
401b
406
407
412
416
402d
404a
402c
404c
404b
500
404d
402b
402a
403
411
412

ELECTROSTATIC IMAGE-DEVELOPING TONER, ELECTROSTATIC IMAGE DEVELOPER, TONER CARTRIDGE, PROCESS CARTRIDGE, IMAGE-FORMING METHOD, AND IMAGE-FORMING APPARATUS

CROSS-REFERENCE TO RELATED APPLICATIONS

This application is based on and claims priority under 35 USC 119 from Japanese Patent Application No. 2010-62246 filed on Mar. 18, 2010 and Japanese Patent Application No 2010-144526 filed on Jun. 25, 2010.

BACKGROUND

1. Technical Field

The present invention relates to an electrostatic image-developing toner, an electrostatic image developer, a toner cartridge, a process cartridge, an image-forming method, and an image-forming apparatus.

2. Related Art

Methods of visualizing image data via an electrostatic latent image such as an electrophotographic method are now widely used in various fields. In the electrophotographic method, an electrostatic latent image formed on the surface of an electrophotographic photoreceptor (an electrostatic latent image carrier, hereinafter sometimes referred to as "a photoreceptor") is developed through a charging process and an exposure process with an electrostatic image-developing toner (hereinafter sometimes referred to as merely "a toner"), and the electrostatic latent image is visualized through a transfer process, a fixing process, and the like.

There is a high possibility that printed matters obtained by fixation of images by an electrophotographic method and the like are brought into contact with many and unspecified persons according to uses, and with sanitation-oriented trend in recent years, a demand for printed matters having an antibacterial effect has increased.

SUMMARY

According to an aspect of the invention, there is provided an electrostatic image-developing toner comprising a binder resin, wherein the content of all the chlorine-substituted benzene derivatives in the electrostatic image-developing toner is about 0.01 ppb or more and about 10 ppb or less.

BRIEF DESCRIPTION OF THE DRAWINGS

Exemplary embodiment(s) of the present invention will be described in detail based on the following figures, wherein:

FIG. 1 is a schematic diagram showing an example of the constitution of the image-forming apparatus for use in the image-forming method in the invention, wherein

200 denotes Image-forming apparatus, 400 denotes Housing, 401*a* to 401*d* denote Electrophotographic photoreceptors, 402*a* to 402*d* denote Charging rolls, 403 denotes Exposure apparatus, 404*a* to 404*d* denote Developing apparatus, 405*a* to 405*d* denote Toner cartridges, 406 denotes Driving roll, 407 denotes Tension roll, 408 denotes Backup roll, 409 denotes Intermediate transfer belt, 410*a* to 410*d* denote First transfer rolls, 411 denotes Tray (a tray for a transfer-receiving medium); 412 denotes Transporting rolls, 413 denotes Second transfer roll, 414 denotes Fixing rolls, 415*a* to 415*d*, 416 denote Cleaning blades, 500 denotes Transfer-receiving medium.

DETAILED DESCRIPTION

The electrostatic image developing toner, electrostatic image developer, image-forming method and image-forming apparatus in the exemplary embodiment of the invention are described below.

[Electrostatic Image-Developing Toner]

The electrostatic image developing toner (hereinafter also referred to as "the toner") in the exemplary embodiment contains at least a binder resin, and the content of all the chlorine-substituted benzene derivatives in the electrostatic image developing toner is 0.01 ppb or more and 10 ppb or less or about 0.01 ppb or more and about 10 ppb or less, and preferably 0.1 ppb or more and 3 ppb or less or about 0.1 ppb or more and about 3 ppb or less. When the content of all the chlorine-substituted benzene derivatives in the electrostatic image developing toner is less than 0.01 ppb or less than about 0.01 ppb, not only the addition becomes difficult in practice but also the antibacterial action to a fixed image is low, and the antibacterial action in every fixed image becomes uneven. On the other hand, when the content of all the chlorine-substituted benzene derivatives in the electrostatic image developing toner exceeds 10 ppb or exceeds about 10 ppb, there is a case where tone reproduction of a fixed image is marred due to the electrical conductivity of all the chlorine-substituted benzene derivatives in particular under a high temperature high humidity condition.

The content of all the chlorine-substituted benzene derivatives in the electrostatic image developing toner may be the amount contained in a coloring agent, or the content may be decreased to the amount determined in advance by washing etc. of a coloring agent, alternatively they may be additionally blended with a toner pigment. More specifically, a method of dispersing them in an organic solvent such as tetrahydrofuran or toluene, stirring, filtering, and repeating the procedure several times, a method of performing Soxhlet extraction of a pigment with the above solvent, and a method of combining these methods are exemplified. All the chlorine-substituted benzene derivatives are those obtained by substituting benzenes with chlorine atoms. Specifically, the content of all the chlorine-substituted benzene derivatives shows the total amount of the chlorine-substituted benzenes such as monochlorobenzene, dichlorobenzene, trichlorobenzene, etc., to the entire amount of the toner.

The toner in the exemplary embodiment may contain a release agent. As the examples of the release agents to be contained, for example, low molecular weight polyolefins, e.g., polyethylene, polypropylene, polybutene, etc.; silicones showing a softening temperature by heating; fatty acid amides, e.g., oleic acid amide, erucic acid amide, ricinoleic acid amide, stearic acid amide, etc.; vegetable waxes, e.g., carnauba wax, rice wax, candelilla wax, Japan wax, jojoba oil, etc.; animal waxes, e.g., bees wax, etc.; mineral and petroleum waxes, e.g., montan wax, ozokerite, ceresin, paraffin wax, microcrystalline wax, Fischer-Tropsch wax, etc.; ester waxes, e.g., fatty acid ester, montanic acid ester, carboxylic acid ester, etc.; and modified products of them are exemplified. These release agents may be used alone, or may be used in combination of two or more.

Release agents for use in the toner of the exemplary embodiment are preferably release agents having low compatibility with the binder resin, for example, release agents of low polarity such as polyethylene, polyolefin and the like from the point of obtaining a good peeling property of a halftone image, and the melting temperature thereof is preferably 100° C. or more in view of a good peeling property of the toner from the paper and coming out of uneven gloss with difficulty. Since it is necessary for release agents to enter between the fixing member and the image within a short time, the above-exemplified release agents are preferably used.

Further, each material constituting the toner in the exemplary embodiment will be described below in detail.

The examples of binder resins to be used include a homopolymer and a copolymer of styrenes, e.g., styrene, chlorostyrene, etc.; monoolefins, e.g., ethylene, propylene, butylenes, isoprene, etc.; vinyl esters, e.g., vinyl acetate, vinyl propionate, vinyl benzoate, vinyl butyrate, etc.; α-methylene aliphatic monocarboxylic esters, e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers, e.g., vinyl methyl ether, vinyl ethyl ether, vinyl butyl ether, etc.; and vinyl ketones, e.g., vinyl methyl ketone, vinyl hexyl ketone, vinyl isopropenyl ketone, etc. In particular, as the representative binder resins, polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and the like can be exemplified. Polyester, polyurethane, an epoxy resin, a silicone resin, polyamide, modified rosin, a paraffin wax and the like can further be exemplified.

As the coloring agents of the toner, magnetic powders, e.g., magnetite, ferrite, etc., carbon black, Aniline Blue, Calyl Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, Pigment Green 7, Pigment Green 36, Pigment Orange 61, etc., can be exemplified as representative coloring agents.

Besides the above, various components such as internal additives, charge controlling agent, inorganic powders (inorganic particles), organic particles, and the like can be added to the toner according to necessity. The examples of internal additives include magnetic powders, for example, metals such as ferrite, magnetite, reduced iron, cobalt, nickel, manganese, etc., alloys, and compounds containing these metals. As charge controlling agents, for example, quaternary ammonium chloride compounds, nigrosine-based compounds, dyes comprising aluminum, iron or chromium complex, and triphenylmethane-based pigments are exemplified. Further, inorganic powders are mainly added for the purpose of adjusting a viscoelastic property of the toner, and all the inorganic particles which are usually used as external additives of toner surfaces as described in detail below, such as alumina, titania, calcium carbonate, magnesium carbonate, calcium phosphate, cerium oxide, and the like are exemplified.

The volume average particle size of the toner in the exemplary embodiment is 3 μm to 10 μm, preferably 3 μm to 9 μm, and more preferably 3 μm to 8 μm. The number average particle size of the toner in the exemplary embodiment is preferably 3 μm to 10 μm and more preferably 2 μm to 8 μm. When the particle size is too small, sometimes not only productivity becomes unstable but also chargeability is insufficient and developing property lowers, while when the particle size is too large, the resolving property of an image lowers.

As the manufacturing method of the toner in the exemplary embodiment, for example, a kneading and pulverizing method of kneading the above binder resin, coloring agent, and, if necessary, a release agent, pulverizing and classifying, and a method of changing the shapes of the particles obtained by the above kneading and pulverizing method by mechanical impact force or heat energy are exemplified.

As the above kneading and pulverizing method, manufacture is carried out, for example, as follows: In the first place, the components such as the binder resin, coloring agent, infrared absorber, and the like are mixed, and then kneaded by melting. As the melt-kneaders, three-roll type, single screw type, double screw type and Banbury mixer type kneaders are exemplified. The obtained kneaded product is roughly pulverized, and then pulverized with a pulverizer, e.g., a micronizer, an Urumax, a Jet-O-miter, a jet mill, a Krypton, or a turbo mill, and then subjected to classifying treatment with a classifier, e.g., an Elbow-Jet, a Micro-Plex, or a DS Separator, to thereby obtain a toner.

[Electrostatic Image Developer]

The toner to be obtained by the manufacturing method of the electrostatic image developing toner in the exemplary embodiment is used as an electrostatic image developer. The developer is not especially restricted so long as it contains the electrostatic image developing toner, and it can take arbitrary composition of components according to purposes. The electrostatic developer may be prepared as one-component type electrostatic image developer comprising the electrostatic image developing toner alone, or may be prepared as two-component type electrostatic image developer in combination with a carrier.

The carrier is not especially restricted and known carriers themselves are exemplified. For example, known carriers such as resin-covered carriers as disclosed in JP-A-62-39879 and JP-A-56-11461 can be used.

As the specific examples of carriers, the following resin-covered carriers are exemplified. That is, as the nuclear particles of the carriers, shaped articles of generally used iron powders, ferrite, and magnetite are exemplified, and the average particle size thereof is 30 μm to 20 μm or so. As the covering resins of the nuclear particles, styrenes, e.g., styrene, parachlorostyrene, α-methylstyrene, etc.; α-methylene fatty acid monocarboxylic acids, e.g., methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate, etc.; nitrogen-containing acryls, e.g., dimethylaminoethyl methacrylate, etc.; vinylnitriles, e.g., acrylonitrile, methacrylo-nitrile, etc.; vinylpyridines, e.g., 2-vinylpyridine, 4-vinylpyridine, etc.; vinyl ethers, e.g., vinyl methyl ether, vinyl isobutyl ether, etc.; vinyl ketones, e.g., vinyl methyl ketone, vinyl ethyl ketone, vinyl isopropenyl ketone, etc.; polyolefins, e.g., ethylene, propylene, etc.; silicones, e.g., methylsilicone, methylphenylsilicone, etc.; copolymers of a vinyl-based fluorine-containing monomer, e.g., vinylidene fluoride, tetrafluoro-ethylene, hexafluoroethylene, etc.; polyesters containing bisphenol, glycol, or the like; epoxy resins; polyurethane resins; polyamide resins; cellulose resins; polyether resins, etc., are exemplified. Especially preferred are resins obtained by polymerization of a polymeric monomer having an aromatic ring, this is for the reason that the resins obtained by polymerization of a polymeric monomer having an aromatic ring are easy to retain static electricity at the aromatic ring part at charging time of the toner, accordingly even when the ratio of the non-discoloring release agent particles are increased in the developer, it is thought that generation of excessive quantity of electrification of the non-discoloring release agent particles can be controlled. More preferred resins are resins obtained by polymerization of a polymeric monomer containing, as a polymeric monomer, styrene whose aromatic ring part easily comes directly into contact with the toner. Resins obtained by the polymerization of a polymerizable monomer having the aromatic rings are preferred. This is for the reason that the directions of aromatic rings in a row of styrene are liable to a uniform direction due to steric hindrance and it is easier to retain static electricity. These resins may be used in one kind alone or in combination of two or more kinds. The content of the covering resin is 0.1 parts by mass to 10 parts by mass or so to the carrier, and preferably 0.5 parts by mass to 3.0 parts by mass. In the manufacture of the carrier, a heating type kneader, a beating type Henschel mixer, a UM mixer and the like can be used, and depending upon the amount of the resin to be covered, it is possible to use a heating type fluidized rolling bed and a heating type kiln.

The mixing ratio of the electrostatic image developing toner and carrier in the electrostatic image developer is not especially restricted and it can be arbitrarily selected depending upon purpose.

[Image-Forming Apparatus]

The image-forming apparatus in the exemplary embodiment will be described in the next place.

FIG. 1 is a schematic diagram showing the example of the construction of the image-forming apparatus to form an image according to the image-forming method in the exemplary embodiment. Image-forming apparatus 200 shown in FIG. 1 comprises housing 400 in which four electrophotographic photoreceptors 401*a* to 401*d* are arranged mutually in parallel along intermediate transfer belt 409. With respect to electrophotographic photoreceptors 401*a* to 401*d*, for example, it is possible for electrophotographic photoreceptor 401*a* to form a yellow color image, electrophotographic photoreceptor 401*b* a magenta color image, electrophotographic photoreceptor 401*c* a cyan color image, and electrophotographic photoreceptor 401*d* a black color image, respectively.

It is possible for each of electrophotographic photoreceptors 401*a* to 401*d* to rotate in a predetermined direction (counterclockwise in the FIGURE), and charging rolls 402*a* to 402*d*, developing apparatus 404*a* to 404*d*, first transfer rolls 410*a* to 410*d*, and cleaning blades 415*a* to 415*d* are arranged in the rotating direction. It is possible to feed the toners of four colors of black, yellow, magenta and cyan respectively housed in toner cartridges 405*a* to 405*d* to developing apparatus 404*a* to 404*d*, respectively. First transfer rolls 410*a* to 410*d* are respectively in contact with electrophotographic photoreceptors 401*a* to 401*d* sandwiching intermediate transfer belt 409.

Further, exposure apparatus 403 is arranged at the predetermined position in housing 400, and it is possible to irradiate the surface of each of electrophotographic photoreceptors 401*a* to 401*d* after being charged with the light of beam coming out of exposure apparatus 403, by which each process of charging, exposure, development, first transfer and cleaning is carried out in sequence in the rotation process of electrophotographic photoreceptors 401*a* to 401*d*, and a toner image of each color is transferred to intermediate transfer belt 409 to be superposed.

Here, charging rolls 402*a* to 402*d* are rolls to bring electrically conductive members (charging rolls) into contact with the surfaces of electrophotographic photoreceptors 401*a* to 401*d* to uniformly apply voltage to the photoreceptors to charge the photoreceptors to predetermined electric potential (the charging process). Incidentally, charging by contact charging system may be performed with a charging brush, a charging film or a charging tube, besides the charging rolls shown in the exemplary embodiment. Alternatively, charging may be performed according to non-contact system with Corotron or Scorotron.

As exposure apparatus 403, optical system apparatus capable of desirably imagewise exposing light sources such as a semiconductor laser, an LED (light emitting diode), a liquid crystal shutter, etc., on the surfaces of electrophotographic photoreceptors 401*a* to 401*d* can be used. Of these apparatus, by the use of exposure apparatus capable of exposure of incoherent light, interference fringe between the conductive base substances and photosensitive layers of electrophotographic photoreceptors 401*a* to 401*d* can be prevented.

In developing apparatus 404*a* to 404*d*, ordinary developing apparatus performing development by contacting or not contacting any of the above-described two-component electrostatic image developers (the developing process) can be used. As such developing apparatus, there is no restriction so long as the two-component electrostatic image developers are used, and known apparatus can be arbitrarily selected depending upon purposes. In the first transfer process, by the application of first transfer bias of reverse polarity of the toner carried by the image-holding member to first transfer rolls 410*a* to 410*d*, a toner of each color is first transferred from the image holding member to intermediate transfer belt 409 in order.

Cleaning blades 415*a* to 415*d* are those to remove remaining toner adhered on the surface of the electrophotographic photoreceptor after transfer process, by which the surface-cleaned electrophotographic photoreceptor is repeatedly offered to the image-forming process. As the materials of the cleaning blades, urethane rubber, neoprene rubber, and silicone rubber are exemplified.

Intermediate transfer belt 409 is supported by driving roll 406, backup roll 408, and tension roll 407 with the prescribed tension, and is capable of rotating without causing deflection by the rotation of these rolls. Further, second transfer roll 413 is arranged so as to come into contact with backup roll 408 with intermediate transfer belt 409 between.

By the application of second transfer bias of reverse polarity of the toner on the intermediate transfer body to second transfer roll 413, the toner is second transferred from the intermediate transfer belt to a recording medium. Intermediate transfer belt 409 which passes between backup roll 408 and second transfer roll 413 is surface-cleaned by cleaning blade 416 arranged in the vicinity of driving roll 406, or by the destaticizer (not shown in the FIGURE), and repeatedly offered to the next image forming process. Further, tray 411 (a transfer-receiving medium tray) is provided in the predetermined position in housing 400, and transfer-receiving medium 500 such as paper in tray 411 is transported between intermediate transfer belt 409 and second transfer roll 413, and further between two fixing rolls 414 contacting to each other in sequence by means of transporting rolls 412, and discharged out of housing 400.

[Image-Forming Method]

The image-forming method in the exemplary embodiment has at least a process of charging a latent image-holding member, a process of forming a latent image on the latent image-holding member, a process of developing the latent image on the latent image-holding member with the electrophotographic developer, a first transfer process of transferring the developed toner image onto an intermediate transfer body, a second transfer process of transferring the toner image transferred to the intermediate transfer body to a recording medium, and a process of fixing the toner image by means of heat and pressure. The developer is a developer at least containing the electrostatic image developing toner of the invention. The developer may be either a one-component type or two-component type developer.

As each of the above processes, a known process in image-forming methods can be used.

As the latent image-holding member, for example, an electrophotographic photoreceptor and a dielectric recording member can be used. In the case of the electrophotographic photoreceptor, the surface of the electrophotographic photoreceptor is uniformly charged with a Corotron charger or a contact type charger, and then exposed to form an electrostatic latent image (the latent image-forming process). In the next place, the latent image is brought into contact with, or in close vicinity to, a developing roll having formed a developer layer on the surface thereof, and toner particles are adhered to the electrostatic latent image to form a toner image on the electrophotographic photoreceptor (the developing process). The formed toner image is transferred to the surface of a transfer-receiving material by means of a Corotron charger and the like (the transfer process). Further, if necessary, the toner image transferred to the surface of the transfer-receiving material is thermally fixed by a fixing apparatus to form a final toner image.

In the thermal fixing with a fixing apparatus, for preventing offset and the like, a release agent is fed to a fixing member in an ordinary fixing apparatus, but it is not necessary to feed a release agent in the fixing apparatus of the image-forming apparatus in the exemplary embodiment, and fixing is performed by oil-less fixing.

A method of feeding a release agent to the surface of a roller or a belt as the fixing member for use in the thermal fixation is not especially restricted and, for example, a pad system of using a pad impregnated with a liquid release agent, a web system, a roller system, and a non-contact type shower system (a spray system) are exemplified, and the web system and roller system are preferred of these systems. These systems are advantageous in that the release agent can be evenly fed and the feeding amount can be easily controlled. Incidentally, for the purpose of feeding the release agent evenly to the fixing member entirely according to the shower system, it is necessary to use a blade or the like separately.

As the transfer-receiving material (a recording material) to which a toner image is transferred, for example, plain paper for use in electrophotographic copiers and printers, and OHP sheets are exemplified.

[Process Cartridge]

In the invention, at least one selected from the group consisting of a latent image holding member, a charging unit for charging the latent image holding member, an exposing unit for exposing the charged latent image holding member to form an electrostatic latent image on the latent image holding member, a developing unit for developing the electrostatic latent image with the electrostatic image developer according to the exemplary embodiment to form a toner image, a transfer unit for transferring the toner image from the latent image holding member to a transfer-receiving member, and a cleaning unit for removing the toner remaining on the surface of the latent image holding member may constitute a process cartridge.

Further, it is preferred for the process cartridge to include at least a developing unit.

The process cartridge is attachable to and detachable from the image-forming apparatus main body, and constitutes the image-forming apparatus together with the image-forming apparatus main body.

[Toner Cartridge]

In the next place, a toner cartridge according the exemplary embodiment will be described below. The toner cartridge according to the exemplary embodiment is attachable to and detachable from the image-forming apparatus, and in the toner cartridge for housing a toner to be supplied to the developing unit provided in the image-forming apparatus, the toner is at least the toner according to the exemplary embodiment. Further, it is sufficient for the toner cartridge according to the exemplary embodiment to contain at least a toner and, for example, a developer may be housed depending upon the mechanism of the image-forming apparatus.

Accordingly, in the image-forming apparatus wherein the toner cartridge has constitution of being attachable and detachable, the toner according to the exemplary embodiment is easily supplied to the image-forming apparatus by the use of the toner cartridge housing the toner according to the exemplary embodiment.

Example

The invention will be described with reference to examples, but the invention is by no means restricted thereto. In the examples, "parts" means "parts by mass" and "%" means "% by mass" unless otherwise indicated.

In the examples, each measurement is performed as follows.

(Measuring Methods of Particle Size and Particle Size Distribution)

Measurements of particle size and particle size distribution are described below.

When the particle sizes to be measured are 2 μm or more, Coulter Multisizer II type (manufactured by Beckman Coulter, Inc.) is used as the apparatus to measure the particle sizes and ISOTON-II (manufactured by Beckman Coulter, Inc.) is used as the electrolyte.

As the measuring method, 0.5 mg to 50 mg of a measuring sample is put in 2 mL of a 5% aqueous solution containing a surfactant as a dispersant, preferably sodium alkylbenzenesulfonate. This is poured into 100 mL of the electrolyte.

The electrolyte in which the sample is suspended is subjected to dispersion treatment with an ultrasonic disperser for about 1 minute. The particle size distribution, of particles having the particle size of 2 μm to 60 μm is measured with Coulter Multisizer II type by using the aperture of diameter of 100 μm, from which the volume average particle size distribution and number average particle size distribution are found. The number of measured particles is 50,000.

Particle size distribution of a toner is measured as follows. The measured particle size distribution data are plotted relative to the divided particle size ranges (channels) to draw the volume cumulative distribution from the particles having a smaller particle size, and the cumulative volume particle size giving accumulation of 16% is defined as $D_{16v}$, the cumulative volume particle size giving accumulation of 50% is defined as $D_{50v}$, and the cumulative volume particle size giving accumulation of 84% is defined as $D_{84v}$.

The volume average particle size in the invention is $D_{50v}$ and the volume average particle size index $GSD_v$ is computed according to the following equation.

$$GSD_v=[(D_{84v})/(D_{16v})]^{0.5}$$

When the particle sizes to be measured are less than 2 μm, a laser diffraction system particle size distribution measuring instrument (LA-700, manufactured by Horiba, Ltd.) is used as the apparatus to measure the particle sizes. As measuring method, the sample in a state of dispersion is adjusted to be about 2 g in a solid state, and ion exchange water is added thereto to make about 40 mL. The resulting sample is poured into a cell to get appropriate concentration, stands still for about 2 minutes, and particle sizes are measured when the concentration in the cell is almost stabilized. The volume average particle size of the obtained every channel is accumulated from the small size side of the volume average particle size and particle sizes giving accumulation of 50% are taken as the volume average particle size.

When powder such as an external additive is measured, 2 g of a measuring sample is put in 50 mL of a 5% aqueous solution of a surfactant, preferably sodium alkylbenzenesulfonate, which is dispersed with an ultrasonic disperser (1,000 Hz) for 2 minutes to prepare a sample, and measuring is performed in the same manner as in the measurement of the foregoing dispersion.

(Measuring Method of Glass Transition Temperature)

The glass transition temperature of the toner is determined according to a DSC (differential scanning calorimeter) measuring method and found from the subject maximum peak measured in conformity with ASTM D3418-8.

In the measurement of the subject maximum peak, DSC-7 (manufactured by Perkin Elmer, Inc.) can be used. The melting temperatures of indium and zinc are used for temperature correction of the detecting part of the apparatus, and heat of fusion of indium is utilized for calorimetric correction. An aluminum pan is used as the sample, and an empty pan is set for reference and measurement is performed at a temperature rising rate of 10° C./min.

(Measuring Methods of Molecular Weight and Molecular Weight Distribution of Toner and Resin Particles)

The molecular weight distribution is measured on the following condition: The GPC: "HLC-8120GPC, SC-8020 apparatus (manufactured by TOSOH CORPORATION)", the columns: two columns of "TSK gel and Super HM-H (6.0 mm ID×15 cm, manufactured by TOSOH CORPORATION)", and the eluent: THF (tetrahydrofuran). The experiment is performed on the following condition: the sample concentration: 0.5%, the flow rate: 0.6 mL/min, the sample injection: 10 μL, the measuring temperature: 40° C., and the detector: an IR detector. The calibration curve is prepared with ten polystyrene standard samples of TSK Standards: "A-500", "F-1", "F-10", "F-80", "F-380", "A-2500", "F-4", "F-40", "F-128", and "F-700" (manufactured by TOSOH CORPORATION).

(Measurement of the Content of all the Chlorine-Substituted Benzene Derivatives in the Toner)

I. GC/MS Measuring Condition:

Gas chromatograph (GC): HP6890 (manufactured by Agilent Technologies)

Mass spectrometer (MS): Autospec-Ultima (manufactured by Micromass)

Column: ENV-5MS (inner diameter: 0.25 mm, length: 30 in, thickness: 0.25 μm, manufactured by Kanto Chemical Co., Inc.)

Injection temperature: 280° C.

Carrier gas: helium (1.5 mL/min, constant flow rate mode)

Injection amount: 10 μL, (splitless)

Transfer line temperature: 280° C.

Ionization method: electron impact ionization method

Ion detecting method: selected ion detection method (SIM) by Lock Mass method

II. Measuring Method:

A toner (1.0 g) is dissolved in sulfuric acid to make 50 mL of a constant volume. One (1) mL of the solution is fractioned, and 4 mL of hexane and the known amount of cleanup spike are added thereto for liquid-Liquid extraction, and a hexane layer is fractioned. This operation is repeated two times, and the obtained hexane layer is concentrated to about 1 mL and then cleaned-up by using silica gel cartridge (Supelclean LC-Si, 6 mL Glass Tube, 1 g, manufactured by Supelco Inc.). After concentrating 10 mL of the obtained hexane eluate, standard material in syringe spike is added to make 50 μL, which is the analytical test solution, and the content is determined by the calibration curve.

The invention will be described with reference to more specific examples and comparative examples, but the invention is by no means restricted thereto. In the following description, "parts" means "parts by mass" unless otherwise indicated.

Manufacture of Pigment 1:

One (1) part of Pigment Green 7 (manufactured by BASF Japan Ltd.) is dispersed in 100 parts of acetone and stirred for 1 hour, and then the dispersion is filtered. This process is repeated three times and then the reaction product is dried to obtain Pigment 1.

Manufacture of Pigment 2:

One-hundred (100) parts of a mixed solvent of tetrahydrofuran/toluene (1/1) is added to 1 part of Pigment 1, the solution is stirred for 1 hour and then filtered. This process is repeated two times and then the reaction product is dried to obtain Pigment 2.

Manufacture of Pigment 3:

One-hundred (100) parts of a mixed solvent of tetrahydrofuran/toluene (1/1) is added to 1 part of Pigment 2, the solution is stirred for 1 hour with an ultrasonic disperser (GSD1200AT, manufactured by Sonic Technology, Inc.) at maximum output, and then filtered and dried to obtain Pigment 3.

Manufacture of Pigment 4:

Dispersing condition used in the manufacture of Pigment 3 is repeated with Pigment 3 to obtain Pigment 4.

Manufacture of Pigment 5:

One-hundred (100) parts of a mixed solvent of tetrahydrofuran/toluene (1/1) is added to 1 part of Pigment 2, the solution is stirred for 1 hour with the ultrasonic disperser used in the manufacture of Pigment 3 at maximum output, and then Soxhlet extraction is performed for 2 hours. After filtration of the reaction product, 100 parts of tetrahydrofuran is added thereto, and then the solution is stirred for 1 hour, filtered, and dried to obtain Pigment 5.

Manufacture of Pigment 6:

Pigment 6 is manufactured in the same manner as in the manufacture of Pigment 5 except for changing Soxhlet extraction to 24 hours, Manufacture of Pigment 7:

Pigment 7 is manufactured in the same manner as in the manufacture of Pigment 5 except for changing Soxhlet extraction to 30 hours.

Manufacture of Pigment 8:

Pigment 8 is manufactured in the same manner as in the manufacture of Pigment 4 except for changing the pigment from Pigment Green 7 to Pigment Green 36 (manufactured by BASF Japan Ltd.).

Manufacture of Pigment 9:

Pigment 9 is manufactured in the same manner as in the manufacture of Pigment 4 except for changing the pigment from Pigment Green 7 to Pigment Orange 61 (manufactured by Ciba Geigy Corp.).

Manufacturing Method of Toner A:

| | |
|---|---|
| Binder resin (styrene-n-butyl acrylate copolymer, copolymerization ratio: 80/20, weight average molecular weight: 65,000, Tg: 65° C.) | 89 parts |
| Polyethylene wax (POLYWAX 725, melting temperature: 105° C., manufactured by Toyo Petrolite Co., Ltd.) | 6 parts |
| Pigment 4 | 5 parts |

The above mixture is thermally kneaded with an extruder, and after cooling, the kneaded product is coarsely pulverized, finely pulverized, and classified to obtain toner mother particles of $D_{50}$=7.0 μm.

Toner A is manufactured by mixing 100 parts by mass of the toner mother particles and 0.7 parts by mass of dimethyl silicone oil-treated silica particles (trade name: RY200, average particle size: 12 nm, manufactured by Nippon Aerosil Co., Ltd.) with a Henschel mixer. The content of all the chlorine-substituted benzene derivatives in Toner A is 1.0 ppb.

Manufacturing Method of Toner B:

Toner B is obtained according to the manufacturing method of Toner A except for changing Pigment 4 to Pigment 3. The content of all the chlorine-substituted benzene derivatives in Toner B is 3.0 ppb.

Manufacturing Method of Toner C:

Toner C is obtained according to the manufacturing method of Toner A except for changing Pigment 4 to Pigment 2. The content of all the chlorine-substituted benzene derivatives in Toner C is 10.0 ppb.

Manufacturing Method of Toner D:

Toner D is obtained according to the manufacturing method of Toner A except for changing Pigment 4 to Pigment 5. The content of all the chlorine-substituted benzene derivatives in Toner D is 0.1 ppb.

Manufacturing Method of Toner E:

Toner E is obtained according to the manufacturing method of Toner A except for changing Pigment 4 to Pigment 6. The content of all the chlorine-substituted benzene derivatives in Toner E is 0.01 ppb.

Manufacturing Method of Toner F:

| <Synthesis of Amorphous Polyester Resin (a)> | |
|---|---|
| Ethylene oxide 2 mol-adduct of bisphenol A | 15% by mol |
| Propylene oxide 2 mol-adduct of bisphenol A | 35% by mol |
| Terephthalic acid | 50% by mol |

A flask having a capacity of 5 liters and equipped with a stirrer, a nitrogen-introducing tube, a temperature sensor, and a distillation column is charged with a monomer having the above composition ratio. The temperature of the flask is increased to 190° C. over 1 hour, and after confirming that the reaction system is stirred without dispersion, when the total amount of three components described above is taken as 100 parts by mass, 1.0% by mass of titaniumtetraethoxide is charged relative to 100 parts by mass of the total component of the three components. Further, the temperature of the reaction system is increased to 240° C. over 6 hours while the produced water is distilled off and then the dehydrative condensation reaction is continued for 2.5 hours at 240° C. to obtain an amorphous polyester resin (a) having a glass transition point of 63° C. and a weight average molecular weight (Mw) of 17,000.

Manufacture of Toner F:

| | |
|---|---|
| Amorphous Polyester Resin (a) | 89.0 parts |
| Pigment 4 | 5 parts |
| Polyethylene wax (trade name: POLYWAX 2000, melting temperature: 126° C., manufactured by Toyo Petrolite Co., Ltd.) | 6 parts |

The above composition is subjected to powder mixing with a Henschel mixer and thermal kneading in an extruder at a prescribed temperature of 100° C., and after cooling, the kneaded product is coarsely pulverized, finely pulverized, and classified to obtain toner mother particles having a volume average particle size $D_{50}$ of 82 μm.

Toner F is manufactured by mixing 100 parts by mass of the toner mother particles and 0.7 parts by mass of dimethyl silicone oil-treated silica particles (trade name: RY200, manufactured by Nippon Aerosil Co., Ltd.) with a Henschel mixer. The content of all the chlorine-substituted benzene derivatives in Toner F is 1.0 ppb.

Manufacturing Method of Toner G:

| | |
|---|---|
| Amorphous Polyester Resin (a) | 89.0 parts |
| Pigment 8 | 5 parts |
| Polyethylene wax (trade name: POLYWAX 2000, melting temperature: 126° C., manufactured by Toyo Petrolite Co., Ltd.) | 6 parts |

The above composition is subjected to powder mixing with a Henschel mixer and thermal kneading in an extruder at a prescribed temperature of 100° C., and after cooling, the kneaded product is coarsely pulverized, finely pulverized, and classified to obtain toner mother particles having a volume average particle size $D_{50}$ of 8.2 μm.

Toner G is manufactured by mixing 100 parts by mass of the toner mother particles and 0.7 parts by mass of dimethyl silicone oil-treated silica particles (trade name: RY200, manufactured by Nippon Aerosil Co., Ltd.) with a Henschel mixer. The content of all the chlorine-substituted benzene derivatives in Toner G is 1.0 ppb.

Manufacturing Method of Toner H:

| | |
|---|---|
| Amorphous Polyester Resin (a) | 89.0 parts |
| Pigment 9 | 5 parts |
| Polyethylene wax (trade name: POLYWAX 2000, melting temperature: 126° C., manufactured by Toyo Petrolite Co., Ltd.) | 6 parts |

The above composition is subjected to powder mixing with a Henschel mixer and thermal kneading in an extruder at a prescribed temperature of 100° C., and after cooling, the kneaded product is coarsely pulverized, finely pulverized, and classified to obtain toner mother particles having a volume average particle size $D_{50}$ of 8.2 μm.

Toner H is manufactured by mixing 100 parts by mass of the toner mother particles and 0.7 parts by mass of dimethyl silicone oil-treated silica particles (trade name; RY200, manufactured by Nippon Aerosil Co., Ltd.) with a Henschel mixer. The content of all the chlorine-substituted benzene derivatives in Toner H is 1.0 ppb.

Manufacturing Method of Toner I:

| | |
|---|---|
| Styrene-n-butyl acrylate resin, copolymerization ratio: 80/20, Tg: 580° C., Mn: 4,000, Mw: 24,000) | 95 parts |
| Carbon black (Mogal L, the content of all the chlorine-substituted benzene derivatives: 0 ppm, manufactured by Cabot Corp.) | 5 parts |
| All the chlorine-substituted benzene derivatives (mixture of chlorobenzene, dichlorobenzene and tricblorobenzene) (a methanol solution diluted to 100 μg/mL is added) | 0.000001 parts |

The above mixture is thermally kneaded with an extruder, and after cooling, the kneaded product is coarsely pulverized, finely pulverized, and classified to obtain toner mother particles of $D_{50}$=5.0 μm.

Toner I is manufactured by mixing 100 parts by mass of the toner mother particles and 0.7 parts by mass of dimethyl silicone oil-treated silica particles (trade name: RY200, manufactured by Nippon Aerosil Co., Ltd.) with a Henschel mixer. The content of all the chlorine-substituted benzene derivatives in Toner I is 1.0 ppb.

Manufacturing Method of Toner J:

Toner J is obtained according to the manufacturing method of Toner I except for not blending all the chlorine-substituted benzene derivatives. The content of all the chlorine-substituted benzene derivatives in Toner J is 0 ppb.

Manufacturing Method of Toner K:

Toner K is obtained according to the manufacturing method of Toner A except for changing Pigment 4 to Pigment 7. The content of all the chlorine-substituted benzene derivatives in Toner K is 0.008 ppb.

Manufacturing Method of Toner L:

Toner L is obtained according to the manufacturing method of Toner A except for changing Pigment 4 to Pigment 1. The content of all the chlorine-substituted benzene derivatives in Toner L is 50 ppb.

Manufacture of Developers:

Developers A to L having toner concentration of 7% by weight are manufactured by mixing each of Toner A to Toner L and ferrite carrier covered with a resin (PMMA having Mw of 70,000).

Methods of Evaluations:

(Evaluation of Antibacterial Action of Image)

<Specimen>

By using each of the above prepared developers, a solid image having an area of 10 $cm^2$ of image area factor of 100% is formed on an image-receiving medium by the use of general non-coat full color special paper as the image-receiving medium on condition of 25° C., 50% RH by means of modified DocuPrint C1616 (manufactured by Fuji Xerox Co., Ltd.). As the specimen, 10 sheets of paper each cut out in a size of 50 mm×50 mm so that the image-fixing area positions in the center are prepared.

<Test Method>

With the above-formed image as specimen, viable bacterial number at 35° C. after 24 hours by film adhesion method is evaluated. As the test bacteria, coli bacilli (ISO3301) are used. For the preparation of test bacterium solution, a general bouillon culture medium is prepared by dissolving 5 mg of meat extract, 10 mg of peptone, and 5 mg of sodium chloride in 1 liter of distilled water. In the next place, a solution is prepared by diluting the above bouillon culture medium with distilled water to 1/500, and coli bacilli are suspended in the solution so that the number of coli bacilli reaches $10^6$ per 1 mL.

Onto the specimen is dripped 0.5 mL of bacterium solution and a polyethylene film is adhered thereto, which is allowed to stand at 35° C. for 24 hours. The coli bacilli adhered to the specimen and the covered film are thoroughly rinsed out into a sterilized Petri dish with 9.5 mL of SCDLP culture medium (manufactured by Nippon Seiyaku Co., Ltd.). The viable bacterial number in 1 mL of the rinsed water is measured by an agar plate dilution method with a standard agar medium for measurement of the number of bacteria (manufactured by Nissui Pharmaceutical Co., Ltd.), from which the rate of sterilization is computed. The rate of sterilization is computed as the ratio of the viable bacterial number after elapse of 24 hours to the viable bacterial number at the beginning time of the test, and the average value of 10 sheets of paper is found and evaluated according to the following criteria. The tolerance is up to grade C.

A: Sterilization rate is 99.9% or more.

B: Sterilization rate is 98% or more and less than 99.9%.

C: Sterilization rate is 97% or more and less than 98%.

D: Sterilization rate is less than 97%.

(Evaluation of Unevenness of Antibacterial Action of Image)

The difference between the values of the least upper bound and the greatest lower bound of the rates of sterilization of 10 sheets is taken as unevenness and evaluated according to the following criteria.

A: Unevenness of sterilization rate is less than 0.5%.

B: Unevenness of sterilization rate is 0.5% or more and less than 1.0%.

C: Unevenness of sterilization rate is 1.0% or more and less than 2.0%.

D: Unevenness of sterilization rate is 2.0% or more.

(Evaluation of Toner Reproducibility Under High Temperature High Humidity)

By using each of the above prepared developers, a solid image having an area of 10 $cm^2$ of image area factor of 100% and an image having an area of 10 $cm^2$ of image area factor of 50% are formed on an image-receiving medium by the use of general non-coat full color special paper as the image-receiving medium on condition of 30° C., 90% RH by means of modified DocuPrint C1616 (manufactured by Fuji Xerox Co., Ltd.). The difference between the concentrations of the image having an image area factor of 100% and the image having an image area factor of 50% measured with X-rite 938 is taken as toner reproducibility and evaluated according to the following criteria.

A: Toner reproducibility is less than 0.90.

B: Toner reproducibility is 0.90 or more and less than 0.95.

C: Toner reproducibility is 0.95 or more and less than 1.00.

D: Toner reproducibility is 1.00 or more.

TABLE 1

| Example No. | Toner | Content of All the Chlorine-substituted Benzene Derivatives (ppb) | Antibacterial Action | Unevenness of Antibacterial Action of Image | Tone Reproducibility under High Temperature High Humidity |
|---|---|---|---|---|---|
| Example 1 | A | 1.0 | A | A | A |
| Example 2 | B | 3.0 | A | A | B |
| Example 3 | C | 10.0 | A | B | B |
| Example 4 | D | 0.1 | B | B | A |
| Example 5 | E | 0.01 | B | B | A |
| Example 6 | F | 1.0 | A | A | A |
| Example 7 | G | 1.0 | A | A | A |
| Example 8 | H | 1.0 | A | A | A |
| Example 9 | I | 1.0 | A | A | A |
| Comparative Example 1 | J | 0 | D | D | A |

TABLE 1-continued

| Example No. | Toner | Content of All the Chlorine-substituted Benzene Derivatives (ppb) | Antibacterial Action | Unevenness of Antibacterial Action of Image | Tone Reproducibility under High Temperature High Humidity |
|---|---|---|---|---|---|
| Comparative Example 2 | K | 0.008 | C | D | A |
| Comparative Example 3 | L | 50.0 | A | B | D |

As the examples of practical use of the invention, there are applications to image-forming apparatus such as copiers using electrophotographic methods and printers.

What is claimed is:

1. An electrostatic image-developing toner comprising chlorine-substituted benzene derivatives;

a binder resin; and a pigment selected from the group consisting of C. I. Pigment Green 7, C. I. Pigment Green 36, and C. I. Pigment Orange 61, wherein the content of all the chlorine-substituted benzene derivatives in the electrostatic image-developing toner is about 0.01 ppb or more and about 10 ppb or less.

2. An electrostatic image developer comprising the toner according to claim 1 and a carrier.

3. A toner cartridge comprising the electrostatic image-developing toner according to claim 1.

4. A process cartridge comprising:

a developing unit for developing the electrostatic latent image with the electrostatic image developer according to claim 2 to form a toner image.

5. An image-forming method comprising:

a charging process for charging a photoreceptor, an exposing process for exposing the charged photoreceptor to form a latent image on the photoreceptor, a developing process for developing the latent image to form a developed image, a transfer process for transferring the developed image to a transfer-receiving member, and a fixing process for fixing a toner on a fixation base material by heating, wherein the toner is the electrostatic image developing toner according to claim 1.

6. An image-forming apparatus comprising:

a latent image-forming unit for forming a latent image on a latent image holding member, a developing unit for developing the latent image into a developed toner image with an electrostatic image developer, a transfer unit for transferring the developed toner image to a transfer-receiving member through or not through an intermediate transfer member, and a fixing unit for fixing the toner image on the transfer-receiving member, wherein the electrostatic image developer is the electrostatic image developer according to claim 2.

7. The electrostatic image-developing toner according to claim 1, wherein the content of all the chlorine-substituted benzene derivatives in the electrostatic image-developing toner is 0.1 ppb or more and 3 ppb or less.

8. The electrostatic image-developing toner of claim 1, wherein the pigment is C. I. Pigment Green 7.

9. The electrostatic image-developing toner of claim 1, wherein the pigment consists of C. I. Pigment Green 7 only.

10. The electrostatic image-developing toner of claim 1, wherein the binder resin is a polyester resin or a styrene-acrylate resin.

* * * * *